US007527560B2

(12) United States Patent
Cadwallader

(10) Patent No.: US 7,527,560 B2
(45) Date of Patent: May 5, 2009

(54) STEERABLE WALKING ROCKING HORSE

(75) Inventor: Robert Cadwallader, Stanfordville, NY (US)

(73) Assignee: Joseph B. Taphorn, Poughkeepsie, NY (US)

( * ) Notice: Subject to any disclaimer, the term of this patent is extended or adjusted under 35 U.S.C. 154(b) by 865 days.

(21) Appl. No.: 11/006,676

(22) Filed: Dec. 8, 2004

(65) Prior Publication Data

US 2007/0296255 A1 Dec. 27, 2007

(51) Int. Cl.
*A63G 13/06* (2006.01)

(52) U.S. Cl. ..... 472/99; 472/102; 280/1.175

(58) Field of Classification Search ..... 472/95–102; 297/45, 271.5, 271.6, 272.1, 272.2; 280/1.175, 280/1.181–1.184
See application file for complete search history.

(56) References Cited

U.S. PATENT DOCUMENTS 152,474 A * 6/1874 Emery ..... 472/102
1,638,951 A * 8/1927 Nentwig ..... 472/99
2,239,982 A * 4/1941 Welch et al. ..... 280/1.177
2,490,059 A * 12/1949 Jacobs ..... 280/1.175
2,561,301 A * 7/1951 Weglarz ..... 280/1.175
2,680,020 A * 6/1954 Dwyer ..... 472/99
3,848,869 A * 11/1974 Morrison ..... 280/1.22
4,807,926 A * 2/1989 Brunn ..... 297/33
4,834,402 A * 5/1989 Jian ..... 280/1.175
4,989,856 A * 2/1991 Shieh ..... 280/1.175

* cited by examiner

*Primary Examiner*—Kien Nguyen

(57) ABSTRACT

A rocking horse has two arcuate members or rockers which can held in spaced relation to a supporting surface during a portion of the rocking cycle by stirrups. During this portion, the rockers can move with respect to the stirrups and hence with respect to the supporting surface to take a step forward and/or turn. The horse moves using inertial forces inherent in the rocking motion and/or riding activity.

8 Claims, 6 Drawing Sheets

STEERABLE WALKING ROCKING HORSE

INTRODUCTION

1. Field of the Invention

This invention relates to rocking horses, rocking chairs, and the like, and more particularly, to making rocking horses and the like move forward and turn by rocking. More specifically, it involves arrangements for translating rocking motion into linear motion and for guiding the linear motion.

2. Background of the Invention

Common examples of devices employing rocking motion are rocking horses and rocking chairs. Rocking horses are toys that are large enough for a child to ride, and are mounted on rockers. Rocking chairs are chairs having legs set on rockers. Rockers are one of two curved or arcuate pieces of wood or the like upon which a rocking horse or a rocking chair rocks. Rocking horses and rocking chairs and the like generally remain in place during rocking.

3. Prior Art

The prior art includes the above-mentioned rocking horses and rocking chairs.

SUMMARY OF THE INVENTION

Accordingly, it is an object of the invention to enable rocking horses, rocking horses, and the like, to move during the rocking motion.

Another object of the invention is to enable a moving rocking horse, rocking chair, or the like, to be steered during the rocking motion.

Still another object of the invention is to enable the above objects to be easily achieved by the rider or occupant of a rocking horse or rocking chair.

A further object of the invention is to provide simple and inexpensively manufactured arrangements for accomplishing the above objects.

Yet another object of the invention is to provide a rocking motion to linear motion conversion mechanism that is useful in other devices.

According to the invention, energy created and/or otherwise available during rocking is transformed into a forward (steps) or to a lateral (steering) movement. The rockers or arcuate members of conventional rocking horses or chairs, etc., may each be equipped with a relatively movable stirrup or assembly or component or element which supports the rocker or arcuate element in spaced relationship to its normal rocking surface at some point during the rocking motion. The relatively movable stirrup or assembly or component or element may have a home position on its rocker or arcuate member in which no relative movement occurs during normal rocking motion, and other positions in which relative movement may occur (the greater the distance of the other position from the home position, the greater the relative movement possible). If both stirrups are displaced an equal amount, forward, straight ahead movement of the rocking horse may occur during rocking motion. If one stirrup is moved differentially with respect to he other, turning movement in a direction opposite the stirrup most displaced, may take place.

The rocking horse or chair, at rest, may be supported via its rockers or arcuate members, indirectly upon the floor or other supporting surface through their corresponding stirrups. If a rider mounts the horse or chair and rocks it off of the stirrups so that the rockers or arcuate members rest directly on the floor instead of through the stirrups, the moveable stirrups may be displaced to another position in which movement of the horse or chair with respect to the stirrups and the floor may take place when the horse or chair is rocked thereon.

In the preferred embodiment shown, the stirrups may be shifted forward from their home position by the rocking-horse rider during the back portion of a rocking cycle. During the subsequent front portion of that rocking cycle, the rockers or arcuate members will rise up on the now displaced stirrups and thereafter slide freely forward thereon carrying the horse and rider forward a step, the action being abetted by the rider's pressure on the stirrups and pushing forward on the horse (the rider somewhat imitating the normal forward position of a horse rider). Forward rocking motion may come to a stop with the rockers in full engagement with the floor. During the subsequent rearward motion in the rocking cycle, the rockers will rise upon the stirrups and return to direct contact with the floor, freeing the stirrups again for forward displacement from the home position by the rider during a latter part of the backward portion of the present rocking cycle and/or the early part of the forward portion of the next rocking cycle. This action may be repeated in subsequent rocking cycles to translate the rocking horse as far as desired with respect to its supporting surface such as a floor.

If only one stirrup is displaced with respect to its rocker or arcuate member, only that rocker or arcuate member will be allowed to move during the rocking motion, resulting in turning motion of the rocking horse about the other stirrup with respect to its supporting surface.

In the preferred embodiment, the movable stirrups or slide assemblies or components or elements which support each rocker or arcuate member in spaced relationship to its normal rocking surface at some point during the rocking motion, are movable freely along the rockers or arcuate elements when the latter are resting directly on the floor. This situation obtains when the horse is rocked to the rear. The stirrups or movable assemblies or components or elements are pushed forward on the rockers or arcuate elements proby the feet of the rider.

When the horse is rocked back, it moves off the stirrups or movable assemblies or components or elements on which it may normally rest and frees them for movement forward. If the rider now pushes forward with his legs on the stirrups or movable assemblies or components or elements, the latter will advance forward on the rockers or arcuate elements. When the horse tips forward in its rocking cycle, the stirrups make contact with the floor, thus raising the rockers or arcuate elements out of contact with the floor. Continued forward rocking motion of the horse, abetted by the rider pushing the horse forward against the stirrups, causes the horse to move forward with respect to the floor through the stirrups. This forward motion of the horse until the rocking action of the horse again puts the rockers or arcuate members in contact with the floor where friction takes over, this time at their forward ends. Forward motion of the horse may also be limited by the amount of relative motion accommodated between the rockers and the stirrups. Thus the horse advances through the stirrups, returning the stirrups to their normal position relative to the rockers.

When the horse and rider rock back, the rockers also rock back over the stirrups to where rocking motion continues with them on the floor and the stirrups are free to move forward again with respect to the rockers (if the rider the rider desires to force them forward again). If the rider wishes to continue forward motion of the horse, the action, including forward shifting of the stirrups in rhythm with the rocking action, is repeated.

By reducing the amount of forward displacement of the stirrups or movable assemblies or components or elements, less forward movement of the horse will occur. By differentially displacing them, turning movement in the direction of the one less displaced, will occur.

An advantage o the invention is that it develops a child's sense of timing, coordination, and dexterity. To cause the rocking horse to move forward, a child must first move the stirrups or movable assemblies or components or elements forward sometime during the back portion of the rocking cycle. Then during the front portion of the rocking cycle, when the rockers or arcuate elements have moved forward onto the stirrups or movable assemblies or components or elements, he may exert the pressure on the stirrups to move the rockers, and hence the horse, forward thereon; later he may move the stirrups forward again to continue forward movement.

Steering then becomes the next challenge. Only one or the other stirrup or movable assembly or component or element need be moved; the rocking horse turning in the direction of the side whose stirrup was not moved from its normal position. Thereafter the child may experiment with power turns; both of the stirrups or movable assemblies or components or elements being moved, but differentially so that forward motion and steering are simultaneously effected.

BRIEF DESCRIPTION OF PREFERRED-INVENTION-EMBODIMENT DRAWINGS

These and other objects, features, and advantages of the invention will become apparent from a consideration of the appended drawings, when considered with the following description, of a preferred embodiment of the invention, wherein.

Figure 7:
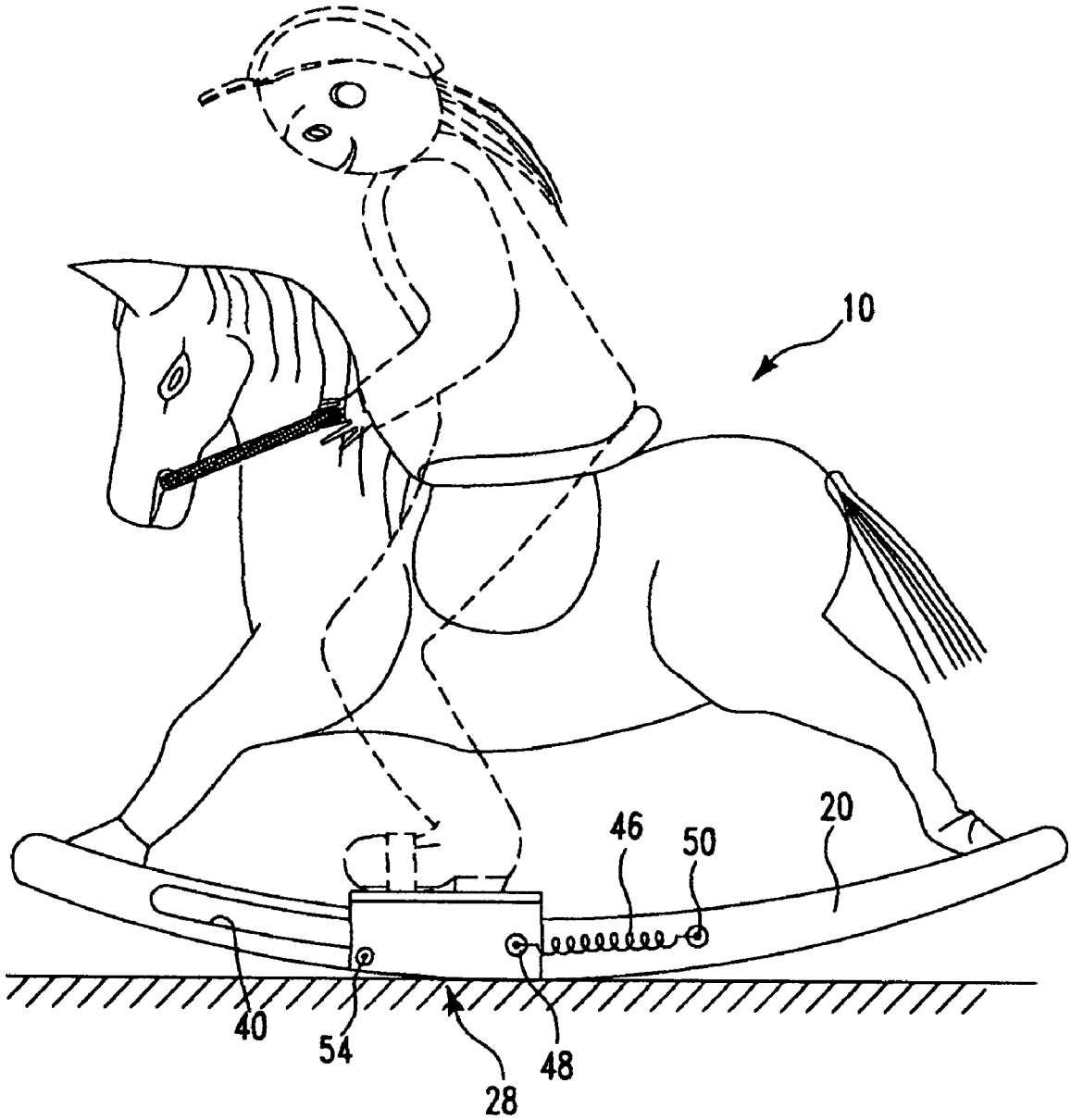
Figure 8A:
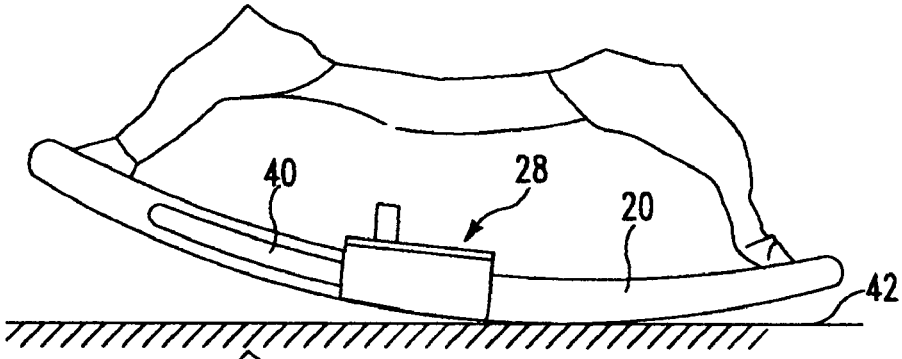
Figure 8B:
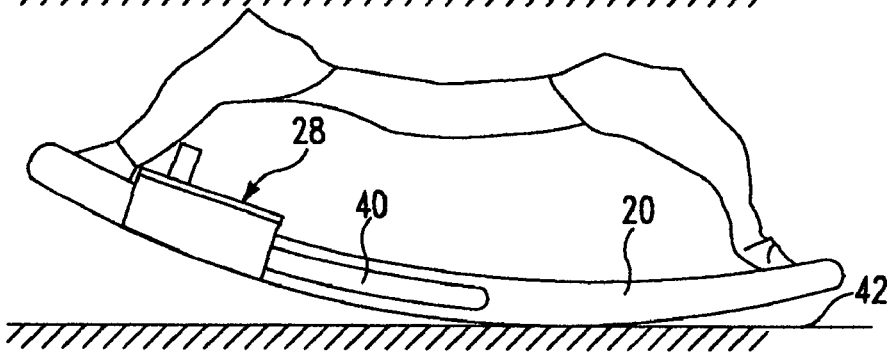
Figure 8B:
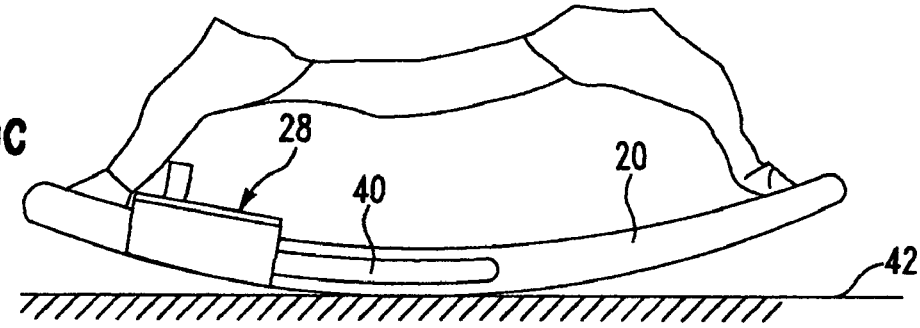
Figure 8D:
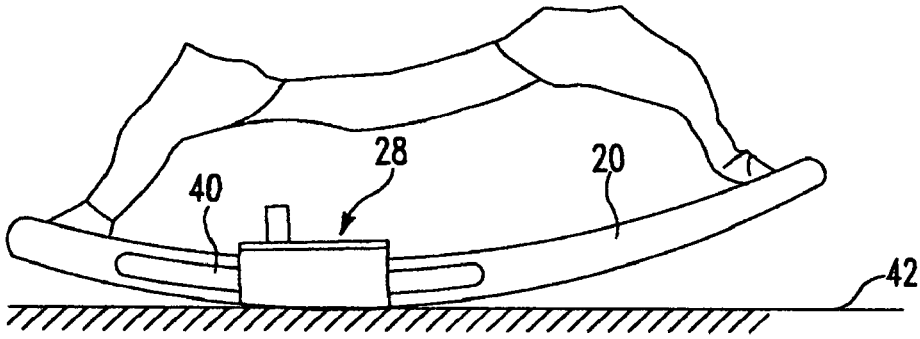
Figure 8E:
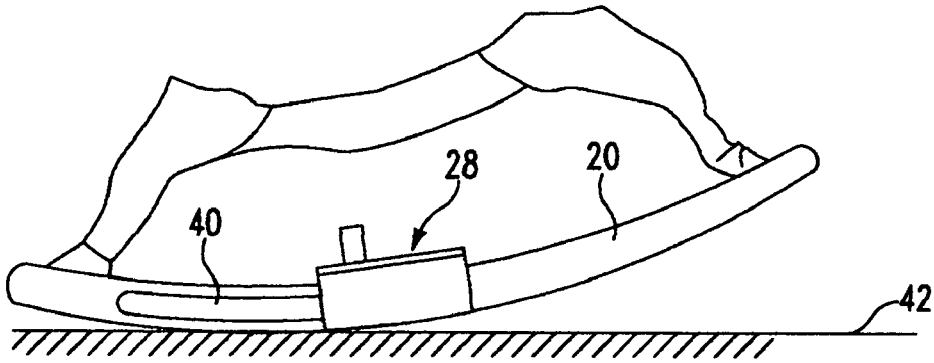

FIG. 7 is a side view of a rocking horse constructed according to the invention, in the normal position of rest and mounting a rider about to lean backwards to induce the backwards portion of a rocking motion during which he or she will be free to move one or both movable stirrups or assemblies or components or elements forward on the rockers or arcuate members should he or she be inclined to induce a tuning or walking action of the rocking horse, and a spring is employed to urge a stirrup or movable assembly or component or element to home position; and FIG. 8 is a composite view showing the actions of a movable stirrup or assembly or component or element during a rocking and walking action of the rocking horse of FIG. 7 (sans spring), wherein FIG. 8*a* depicts a rocked back position;

FIG. 8*b* depicts the stirrup or slide assembly or component or element on the near side having been moved forward by a rider (not shown) to a walking or turning position while the horse is in a rocked back position;

FIG. 8*c* depicts the horse is in a rocked forward position in which the slide assembly or component or element on the near side rests on the supporting surface and the corresponding rocker or arcuate element is free to slide therethrough;

FIG. 8*d* depicts the horse is in a partially rocked forward position in which the stirrup or slide assembly or component or element on the near side still rests on the supporting surface but the corresponding rocker or arcuate element has slid partially forward therethrough under the weight of the horse and a rider thereon and inertial forces, the sliding action resulting in forward walking or translatory motion of the horse if the elements on both sides had been moved forward and in turning to other side if only the element on one side had been moved forward;

FIG. 8*e* depicts the horse in a fully rocked forward position in which the corresponding rocker or arcuate element has slid completely forward through slide assembly or component or element on the near side and may itself again rest on the supporting surface, and from which the horse rocking back action to a FIG. 8*a* position will begin.

DETAILED DESCRIPTION OF PREFERRED-INVENTION-EMBODIMENT

Figure 1:
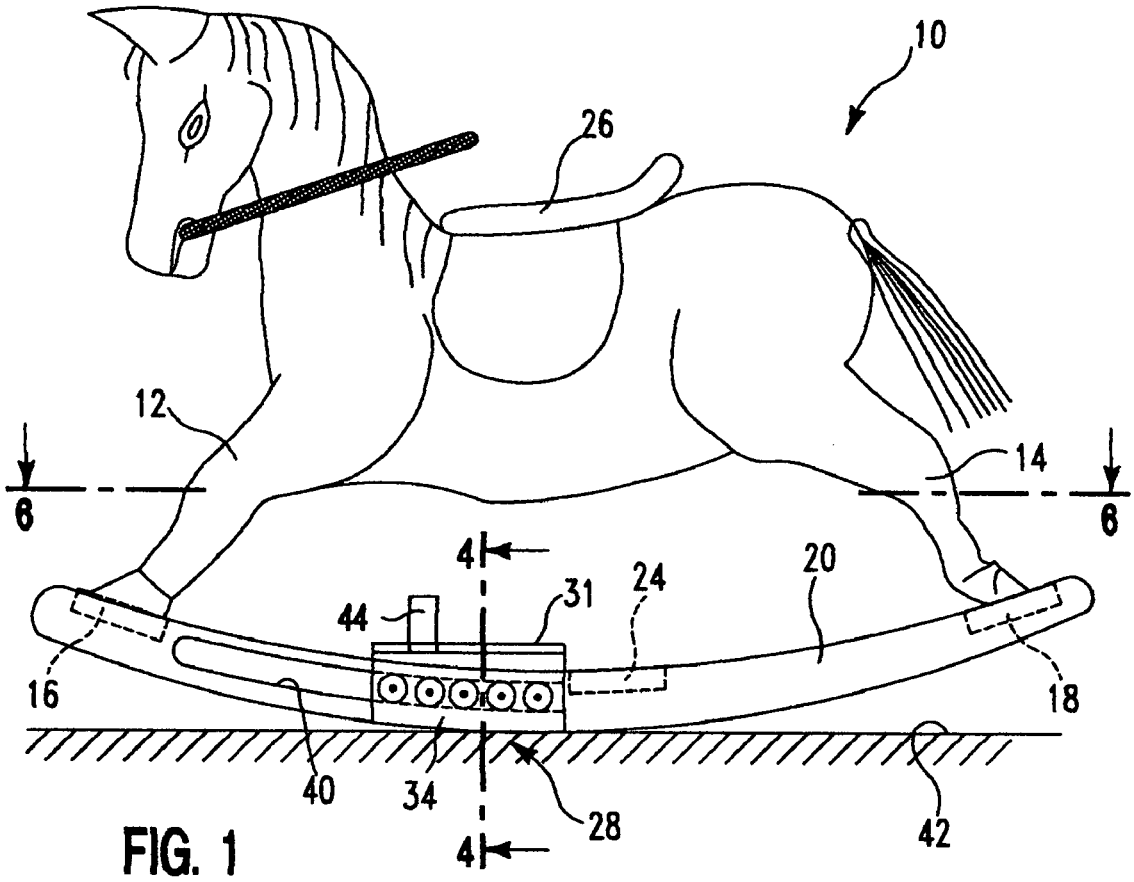
FIG. 1 is a side view of a rocking horse constructed according to the invention, in the normal position of rest.
Figure 2:
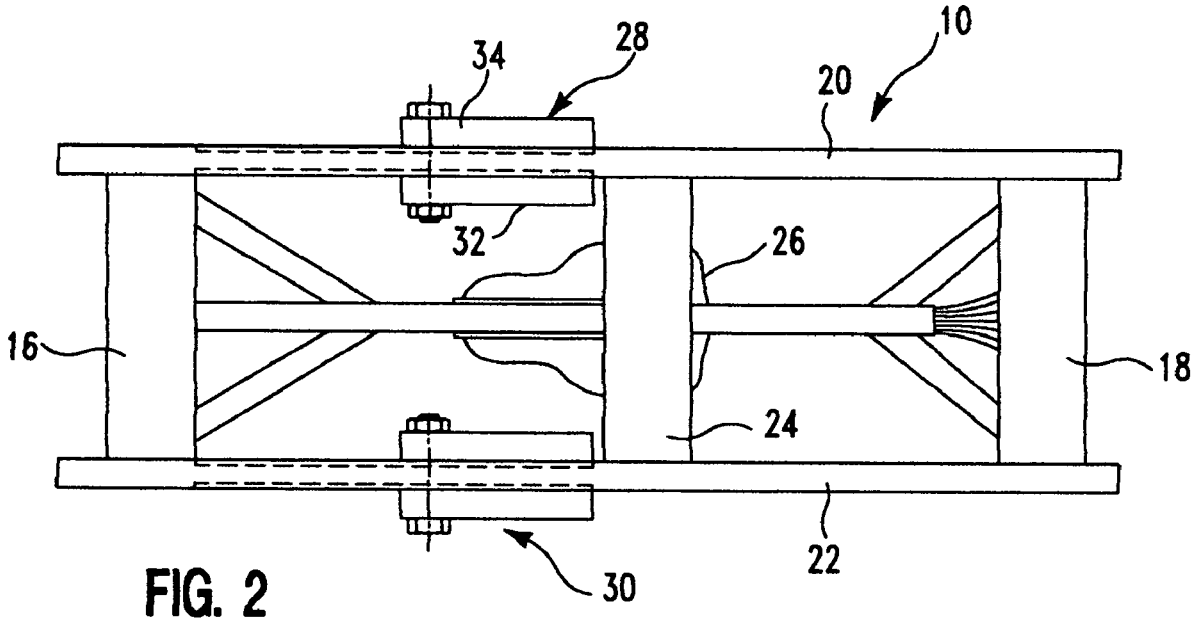
FIG. 2 is a bottom view of the rocking horse of FIG. 1.
Figure 3:
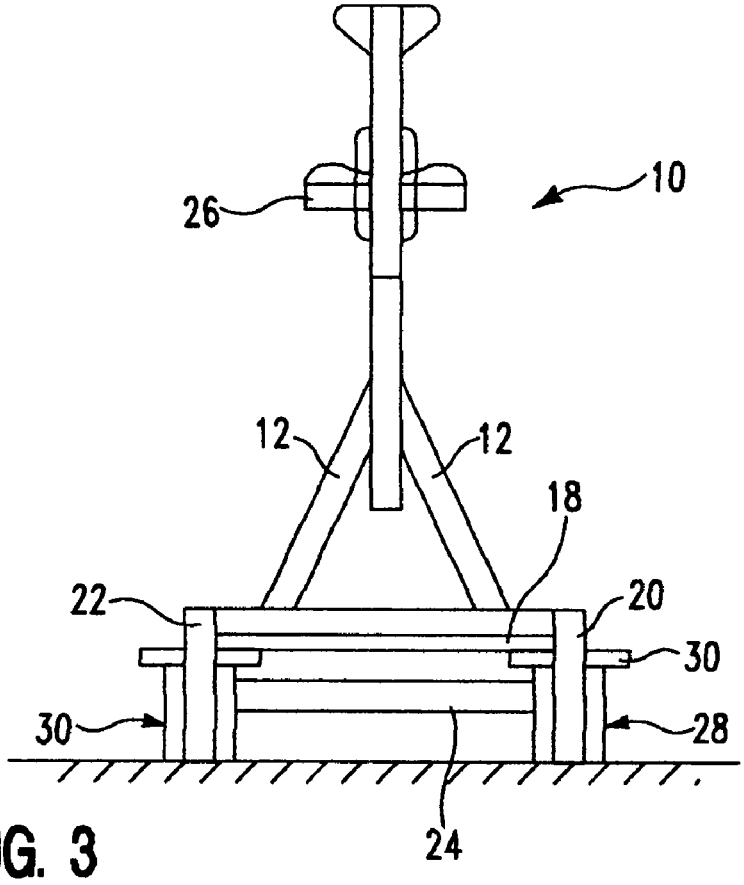
FIG. 3 is a front view of the rocking horse of FIG. 1.

Referring now more particularly to the drawings, there is shown in FIGS. 1-3 a rocking horse generally indicated by the numeral 10 having front legs 12 and rear legs 14 respectively mounted on front and rear cross bars 16 and 18 rigidly secured at their ends to left and right rocker or arcuate members 20 and 22 respectively. An intermediate crossbar 24 connected at its ends to the rockers 20 and 22, also serves as a footrest for a child rider seated on the rocking horse via a saddle 26 on its back.

Figure 4:
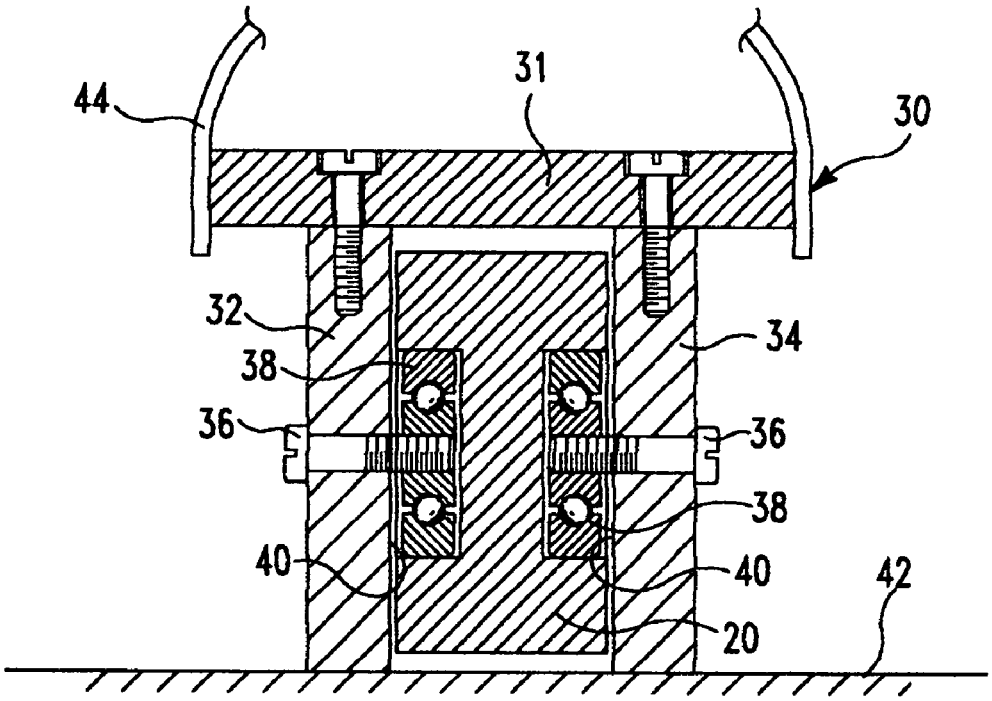
FIG. 4 is a sectional view taken along the line 4-4 of FIG. 1.
Figure 5:
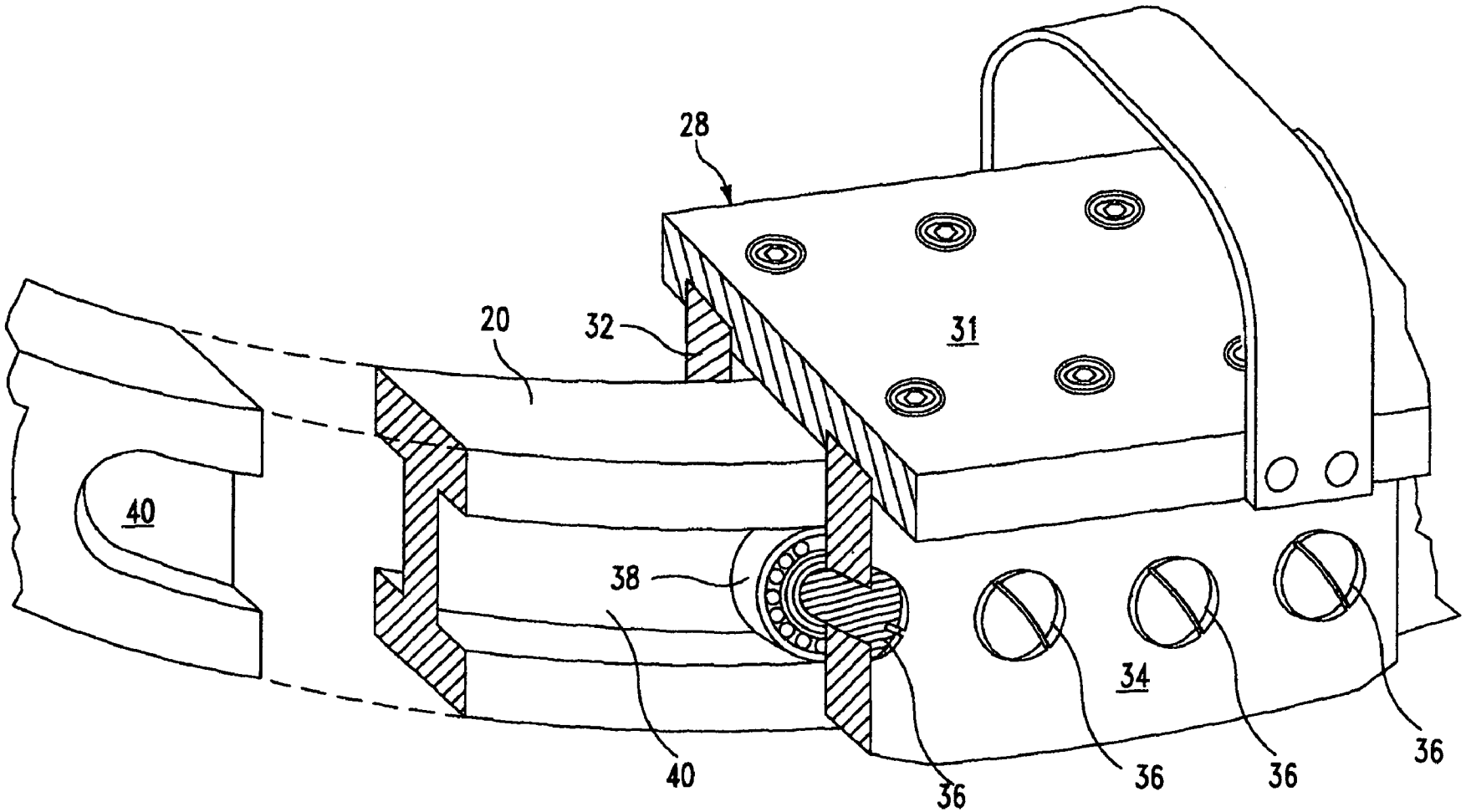
FIG. 5 is an enlarged view in perspective, partly broken away, of a rocker or arcuate member and stirrup or movable component or element.

The left and right rockers or arcuate members 20 and 22 movably mount stirrups or assemblies or components or elements generally indicated by the numerals 28 and 30 respectively. Stirrups 28 and 30 are duplicates of the other, so only stirrup 28 will be described in detail. As best seen in FIGS. 4 and 5, the stirrup or assembly or component or element 28 consists of a top plate 31 wide enough to accommodate a shoe and inner and outer two side plates 32 and 34 depending rigidly as by grooves and screws from the bottom thereof and spaced apart a width slightly exceeding the thickness of the rocker or arcuate member 20. The interior walls of the two side plates 32 and 34 mount, via screws 36 extending through the side plates, ball bearing sets 38 which are received in matching grooves 40 formed in the vertical sides of the rocker or arcuate member 20. The side plates 34, the sets 38 of ball bearings, and the grooves 40 are of such dimensions and location that the bottom of the top plate 31 is spaced slightly above the rocker 20 and that the lower surfaces of the side plates 32 and 34 are disposed slightly below the lower surface of the rocker 20. This construction allows the stirrup 28 to be slid freely with respect to the rocker 20 when the rocker is directly engaging a horse supporting surface or floor 42 and the stirrup isn't. This construction also allows the rocker 20 to slide freely with respect to the normal horse supporting surface or floor 42 when the stirrup 28 is resting on that supporting surface and the rocker isn't.

Figure 6:
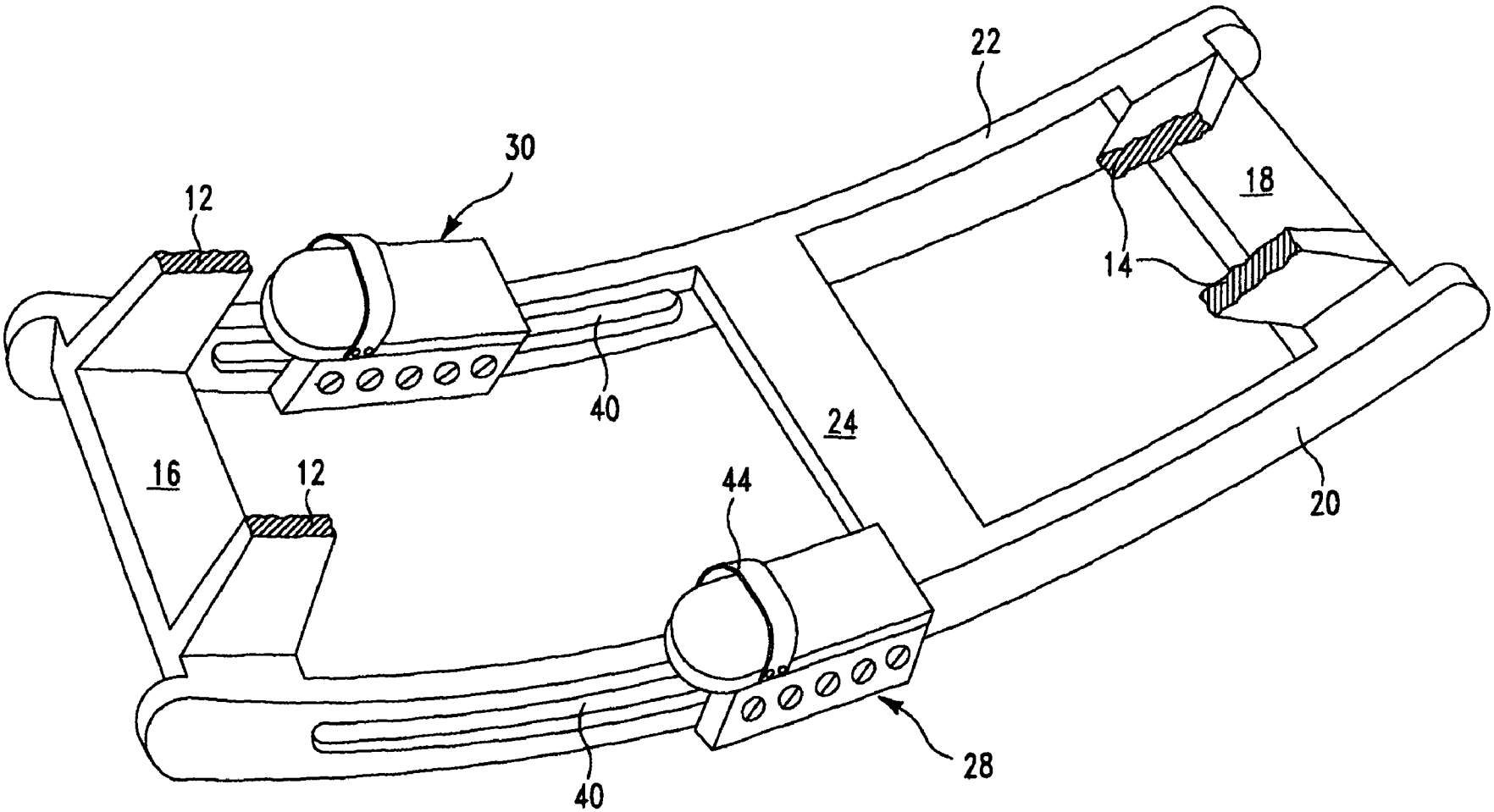
FIG. 6 is a sectional view of a rocker or arcuate member and a movable stirrup or assembly or component or element, taken along the section line 6-6 of FIG. 1.

As best seen in FIGS. 1, 6, 7, and 8, the grooves 40 are cut in the sides of the front ends of the rockers or arcuate members 20 and 22. The rear ends of the grooves 40 may be located so that when the rocking horse is in its normal position of rest defined by the center of gravity, it rests on the floor 42 through the stirrups 28 and 39. When the horse is rocked backwards as by a rider seated thereon, the rockers 20 and 22 come in direct contact with the floor 42 and the stirrups 28 and 30 are lifted free of the floor. Should the rocking rider decide for the rocking horse to travel or turn, he could shift both or one of the stirrups 28 and 30 forward now, as they are free to move along the rockers 20 and 22 on the ball bearing sets 38 rolling in their grooves 40. Both stirrups would be shifted forward if it is desired to travel straight ahead. If it was decided to turn, only the stirrup opposite the proposed direction of turn could be shifted forward (FIG. 6). If a power turn was desired, both stirrups might be shifted forward, the one opposite the proposed direction of turn being shifted more.

A strap 44 extending across the top of each stirrup and attached at its ends to the sides of the top plate 31 of the stirrups, aids the rider in moving the stirrups on the rockers 20 and 22.

To use, a rider would seat himself or herself on the seat 26 of the rocking horse 10 (FIG. 7. He or she could place her feet on the stirrups 28 and 30, nesting them within the straps 44. Rocking motion of the horse could be begun by the rider moving his or her upper torso backwards which would cause the rockers or arcuate members 20 and 22 to rock off of their stirrups 28 and 30 normally on the floor 42 when the horse is at rest (FIG. 7), and themselves rock directly on the floor (FIG. 8*a*). The now off-balance rocking horse will eventually discontinue its backward movement and start forward.

Eventually the rockers 20 and 22 will rock onto the stirrups 20 and 22 and off the floor 42. Where this will be in the rocking cycle is dependent on the position of the stirrups. If they have not been displaced from home position, it will be essentially midway of the going forward portion of the rocking cycle. If the stirrups 28 and 30 have both feet pushed forward by the rider, it will be in the latter part of the forward portion of the rocking cycle.

If the stirrups have not been displaced from home position, the rockers 20 and 22 merely rock over their stirrups 28 and 30 and back onto the floor at their forward ends. Eventually, the forward rocking motion stops and the backward rocking motion begins in normal fashion, the stirrups momentarily separating the rockers from the floor during it. The stirrups will be prevented from engaging in relative movement with respect to their rockers 20 and 22 by the engagement of the sets of ball bearings 38 with the rear ends the slots 40.

In the preferred embodiment shown, the stirrups 28 and 30 can readily be displaced from home position during the back portions of the rocking cycle. Assuming the rider desires the rocking horse to engage in forward travel at maximum speed, he or she will displace the stirrups forward all the way. (This stirrup position is determined by the engagement of the sets of ball bearings 38 with the front ends of the slots 30.) As the rockers 28 and 30 rock up on their stirrups 29 and 30, they will become free of their frictional contact with the floor and free the slide through the stirrups on the sets of ball bearings until either the bearing sets are engaged by the rear ends the rocker slots 40 or the rocking horse 10 has rocked forward so much that the rockers 20 and 22 frictionally engage the floor at their front ends.

Normally the rider will be leaning forward during the forward portion of the rocking cycle, as in normal horseback riding. In so doing he will be imparting forward momentum to the rocking horse by being forward of the center of gravity, which forward inertia will be aided and abetted by any thrust of his legs against the stirrups 28 and 30. Initially the rockers 20 and 22 will be prevented from translating forward by their frictional engagement with the supporting surface 42; however, once they are out of contact with the floor and supported thereon by the stirrups, they will slide forward in the stirrups which are being frictionally held in place by the floor.

The length and location of the grooves 40 are design choices.

A tension spring 46 (FIG. 7) reacting between a stud 48 on the stirrup 48 on the stirrup 28 and a stud 50 on the rocker 20 may be employed to urge the stirrup to home position and retain it there.

A forward step of the rocking horse may begin by the rider of FIG. 7 rocking backwards with the horse 10 eventually assuming a position as shown in FIG. 8*a*. In this back position, though possibly in other back positions wherein the stirrups 28 are no longer in contact with the floor 42, the stirrups 28 may be shifted forward on the slots 40 to the position of FIG. 8*b*. During the rocking forward portion of the rocking cycle, the rockers 20 and 22 will rock off of the floor 42 and onto the stirrups 28 and 30 as shown in FIG. 8*c*. The rockers 20 and 22 now being free of frictional contact with the floor 42, will slide through the stirrups 28 and 30 and through the position shown in FIG. 8*e* under the influence of rocking forward inertia and any push the rider may be exerting between the stirrups and the rocking horse 10. Continued forward rocking motion will result in the horse step continuing forward until the back ends of the slots 40 on the rockers 20 and 22 reach the bearing sets 38 on the tempoarily-fixed-on-the-floor-while-supporting-the-rockers-in-spaced-relation-to-them stirrups 28 and 30 and the forward ends of the rockers 20 and 22 engage the floor 42 as shown in FIG. 8*e*. The backward motion portion of the rocking cycle would now take place, the horse rocking over the stirrups now in normal position.

If rocking over the stirrups is too bumpy, the lower surfaces on the front and rear ends of the stirrup side walls 32 and 34 may be chamfered to smooth the transition.

To steer, only one of the stirrups needs be moved forward, turning on the other stirrup taking place while the rocker slips forward through its displaced stirrup.

To effect a power turn, both stirrups would be displaced forward, the one on the side of the desired direction of turn being moved least forward.

While there has been shown and described preferred embodiments of the invention, it will be apparent to those skilled in the art that other and different applications may be made of the principles of the invention. It is intended therefore to be limited only by the spirit of the appended claims.

What is claimed is:

1. In a device for having a rocking motion normally in place on a supporting surface, an arcuate member for normally resting on the supporting surface during rocking motion, and an element on said arcuate member movable relative to the member from a normal inoperative position to an operative position and for resting on the supporting surface instead of the arcuate member in the operative position, wherein the position of the arcuate member with respect to the element can be changed when the element rests on the supporting surface, wherein the position of the arcuate member with respect to the element is changed by shifting weight on the arcuate member, wherein the center of gravity on the arcuate member is approximately midway its length, and the element has a normal position with respect to the arcuate member approximately midway its length, wherein the element has an operative position near one end of the arcuate member, wherein the element operative position is near the front end of the arcuate member, wherein the element is movable forward from its normal position to its operative position by a device occupant imparting rocking motion to the device during the backward portion of a rocking cycle.

2. In a device according to claim 1, wherein the arcuate member moves forward with respect to the element while the element is in operative position to place the element back in its normal position with respect to the arcuate member and from which it may be again moved to its operative position by a device occupant imparting rocking motion to the device in the later part of the same rocking cycle.

3. In a device according to claim 1, wherein the front portion of the arcuate member has a groove in each of its sides, and the element straddles its arcuate member to a depth below the element and has a bearing cooperating with each of the member's groove to enable it to support the member when the element is between the member and a supporting surface.

4. In a device for having a rocking motion normally in place on a supporting surface, an arcuate member for normally resting on the supporting surface during rocking motion, and an element on said arcuate member movable relative to the member from a normal inoperative position to an operative position and for resting on the supporting surface instead of the arcuate member in the operative position, wherein the position of the arcuate member with respect to the element can be changed when the element rests on the supporting surface, wherein the position of the arcuate member with respect to the element is changed by shifting weight on the arcuate member, wherein the center of gravity on the arcuate member is approximately midway its length, and the element has a normal position with respect to the arcuate member approximately midway its length, wherein the element has an operative position near one end of the arcuate member, wherein the element is movable from its normal position to its operative position by a device occupant imparting rocking motion to the device, wherein the arcuate member moves forward with respect to the element while the element is in operative position to place the element back in its normal position with respect to the arcuate member and from which the element may be again moved to its operative position by a device occupant imparting rocking motion to the device in the later part of the same rocking cycle.

5. In a device for having a rocking motion normally in place on a supporting surface, a right-side arcuate member for normally resting on the supporting surface during rocking motion, a left- side arcuate member for normally resting on the supporting surface during rocking motion, and an element on one of said arcuate members and movable relative to the member from a normal inoperative position to an operative position and for resting on the supporting surface instead of the arcuate member when moved to the operative position, wherein there is an element on each of said arcuate members that is movable relative to the member and for resting on the supporting surface instead of the corresponding arcuate member when moved to an operative position, wherein the front portion of each arcuate member has a groove in each of its sides, and each element straddles its arcuate member to a depth below it and has a bearing cooperating with each of the member's groove to enable it to support the member when it is between the member and a supporting surface.

6. A method for causing a rocking horse having a rocker to step forward from a normal position on a supporting surface, comprising the steps of rocking the horse, displacing an element capable of supporting the rocker on the supporting surface and having a normal position on the rocker midway of the rocker forward during a back portion of the rocking cycle, and moving the rocker forward on the element during a front portion of the rocking cycle when the rocker is supported by the element, wherein the rocking horse has two rockers and each has a displaceable element and is movable forward.

7. A method for causing a rocking horse having a rocker to step forward on a supporting surface according to claim 6, wherein if both elements are moved equally forward during a rocking cycle, the rocking horse steps forward during that cycle.

8. A method for causing a rocking horse having a rocker to step forward on a supporting surface according to claim 6, wherein if an element is moved forward more than the other, the rocking horse turns in the direction of the other element.

* * * * *